US007694848B2

(12) United States Patent
Petry

(10) Patent No.: US 7,694,848 B2
(45) Date of Patent: Apr. 13, 2010

(54) ASSEMBLY FOR DISPENSING PRE-MOISTENED TOWELETTES

(76) Inventor: Thomas S. Petry, 3500 Cypress La., Lafayette, IN (US) 47905

( * ) Notice: Subject to any disclaimer, the term of this patent is extended or adjusted under 35 U.S.C. 154(b) by 8 days.

(21) Appl. No.: 11/986,207

(22) Filed: Nov. 20, 2007

(65) Prior Publication Data

US 2008/0142542 A1 Jun. 19, 2008

Related U.S. Application Data

(60) Provisional application No. 60/866,478, filed on Nov. 20, 2006.

(51) Int. Cl.
*B65H 1/00* (2006.01)
*A47G 29/00* (2006.01)
*B65H 49/32* (2006.01)

(52) U.S. Cl. ..... 221/283; 221/45; 221/92; 221/93

(58) Field of Classification Search ..... 221/33, 221/34, 45, 46, 47, 48, 49, 56, 58, 59, 60, 221/63, 64, 69, 70, 92, 93, 94, 119, 154, 221/186, 282, 283, 286
See application file for complete search history.

(56) References Cited

U.S. PATENT DOCUMENTS 1,045,311 A * 11/1912 Moberg ..... 242/599.1
2,790,608 A * 4/1957 Sieven ..... 242/596.3
3,086,724 A 4/1963 Powell
D204,595 S 5/1966 Turro
3,310,353 A 3/1967 Cordis
3,794,253 A * 2/1974 Megdall ..... 242/596.3
3,830,198 A 8/1974 Boone
3,943,859 A * 3/1976 Boone ..... 108/27
4,004,687 A * 1/1977 Boone ..... 206/233
4,106,616 A * 8/1978 Boone ..... 206/233
4,181,218 A 1/1980 Cox
4,235,333 A * 11/1980 Boone ..... 206/233
4,373,682 A * 2/1983 Dickson ..... 242/564
4,427,159 A * 1/1984 Miller et al. ..... 242/560
4,978,095 A 12/1990 Phillips
5,248,105 A * 9/1993 Cooker ..... 242/598.5

(Continued)

*Primary Examiner*—Gene Crawford
*Assistant Examiner*—Kelvin L Randall, Jr.
(74) *Attorney, Agent, or Firm*—Daniel L. Boots; Bingham McHale LLP

(57) ABSTRACT

A novel towelette dispensing assembly is presented comprising a housing and a frame wherein the housing is attached the frame, which in turn is releasably secured between the mounting brackets of a conventional toilet tissue roll holder. The frame includes parallel-spaced opposing support arms and mounting means. The mounting means is intended to be positioned on either side of a toilet tissue roll such that the expandable spindle provided as part of a conventional toilet tissue dispenser may engage or pass through said mounting means. The support arms of the frame assembly extend beyond the mounting means to bear against the wall or vertical surface to maintain the frame assembly in a substantially vertical position. One embodiment includes a novel tissue roll spindle. The towelette housing can take various shapes to accommodate a variety of conventional commercial towelette containers. The dispensing assembly is intended to be detachably coupled to a conventional toilet tissue holder in a manner that does not interfere with the dispensing of toilet tissue. By its coupling to the toilet tissue dispenser, the dispenser of this invention is conveniently located near the tissue roll and may be accessed without the user having to come in contact with the assembly.

10 Claims, 10 Drawing Sheets

U.S. PATENT DOCUMENTS

| | | | | |
|---|---|---|---|---|
| 5,311,986 | A | 5/1994 | Putz | |
| 5,439,521 | A | 8/1995 | Rao | |
| 5,605,250 | A | 2/1997 | Meiron | |
| 5,660,313 | A | 8/1997 | Newbold | |
| 5,697,577 | A | 12/1997 | Ogden | |
| 5,765,717 | A | 6/1998 | Gottselig | |
| 5,897,074 | A | 4/1999 | Marino | |
| 5,951,762 | A | 9/1999 | Shangold | |
| D417,351 | S | 12/1999 | Scavuzzo | |
| 6,000,658 | A * | 12/1999 | McCall, Jr. | 242/599 |
| 6,056,235 | A | 5/2000 | Brozinsky | |
| D438,738 | S | 3/2001 | Goodman | |
| 6,364,156 | B1 * | 4/2002 | Smith et al. | 221/46 |
| 6,446,808 | B1 | 9/2002 | Paul | |
| 6,460,799 | B1 | 10/2002 | Ryan | |
| 6,497,345 | B1 | 12/2002 | Wilker | |
| 6,503,326 | B1 | 1/2003 | Mikelionis | |
| 6,536,707 | B2 | 3/2003 | Adelakun | |
| D481,893 | S | 11/2003 | Walther | |
| 6,655,630 | B2 | 12/2003 | Newman | |
| 6,688,551 | B1 * | 2/2004 | He et al. | 242/599 |
| D487,858 | S * | 3/2004 | Richardson | D6/523 |
| 6,745,975 | B2 | 6/2004 | Faulks | |
| D506,632 | S | 6/2005 | Holsclaw | |
| 6,929,148 | B2 | 8/2005 | Haddad | |
| 6,945,493 | B1 | 9/2005 | Gottesman | |
| 6,997,345 | B2 | 2/2006 | Mitchell | |
| 7,070,143 | B2 | 7/2006 | Faulks | |
| 2002/0056785 | A1 | 5/2002 | Newman | |
| 2002/0096597 | A1 * | 7/2002 | Adelakun | 242/588.6 |
| 2004/0099679 | A1 | 5/2004 | Welchel | |
| 2004/0108409 | A1 | 6/2004 | Shahbaz | |
| 2004/0206651 | A1 | 10/2004 | Saito | |
| 2005/0178780 | A1 | 8/2005 | Serfaty | |
| 2005/0284881 | A1 | 12/2005 | Haddad | |

* cited by examiner

ASSEMBLY FOR DISPENSING PRE-MOISTENED TOWELETTES

RELATED APPLICATIONS

This application claims the benefit of U.S. provisional patent application Ser. No. 60/866,478, filed Nov. 20, 2006.

TECHNICAL FIELD

The claimed technology relates generally to an assembly for dispensing towelettes, and more particularly relates to such an assembly removably attached to a conventional toilet tissue dispenser in a manner that does not interfere with the dispensing of toilet tissue.

BACKGROUND

Bathrooms are generally equipped with conventional toilet tissue roll holders. These holders are designed to support, display, and provide convenient access to the typical toilet tissue roll. The conventional holder is composed of a telescoping, spring biased, retractable spindle mounted between a pair of posts or brackets that project outwardly from a wall or vertical surface. Bearing sockets are located adjacent to the distal end of each bracket for receiving the opposing ends of the spindle. The toilet tissue roll is supported about the spindle.

The normal bathroom toilet routine is to use dry toilet tissue for cleaning. It has become apparent that this routine is often insufficient to alleviate the elevated concern of personal hygiene and to satisfy the personal needs of many individuals in today's society. Consequently, the need for convenient hand sanitation prior to leaving the toilet is often not satisfied.

To solve these concerns, pre-moistened tissues, wipes and towelettes have become a common consumer product. However, even though pre-moistened tissues, commonly referred to as "wet wipes," are available, there is no generally accepted or commercially successful dispenser for combining wet wipes or towelettes of any kind and dry toilet tissue on a conventional toilet tissue roll holder intended for personal use. It would be beneficial to have a device that provides a convenient delivery system for a flushable towelette to use on delicate personal areas, as well as to sanitize the hands prior to standing, re-dressing and handling such items as the flush lever, door handle, faucet handles, etc. Such a device would reduce or eliminate the transfer of germs, including Hepatitis A, pathogenic *E. Coli* and *C. Diff.*, which are known to pass via the fecal-oral route.

Since many towelettes used today are of the pre-moistened kind, it is preferable that they be stored in a container that temporarily protects the wipes from the surrounding atmosphere in order to prevent liquid from evaporating from the tissue, in other words, to prevent the wet wipes from "drying out." In addition, the dispenser must permit easy access for the user to the wipes so the wipes can be easily dispensed in the desired amount by the user. These requirements present conflicting criteria since the ease of access requirement often requires that at least a portion of the wet wipes be readily accessible to a user without opening the dispenser.

It is also desirable that the dispenser be reusable so that, after all of the towelettes in a given package are used, the dispenser can be readily opened to insert a new supply of towelettes, thereby eliminating the need to purchase a new dispenser with each new supply of towelettes.

Since many towelettes are normally used in the bathroom, it would be further desirable to provide a means for conveniently locating the dispenser in a location such as that provided by the existing tissue roll holder. Such a storage means would provide the user with a convenient choice of dry or moist tissue. This must not interfere with the normal function of the tissue roll holder and yet should be readily connected to the existing conventional structure without the need for tools or special skills. It would be further desirable if the device would be adaptable to a wide variety of dry tissue roll holders and a variety of heights and locations that commonly occur.

The present claimed technology addresses these needs.

SUMMARY

The present claimed technology relates to a wet wipe dispenser.

One object is to provide an improved device for dispensing wet wipes from a conventional toilet tissue dispenser in a manner that does not interfere with the function of dispensing toilet tissue.

Further objects, features, and advantages will become apparent from a consideration of the following description and accompanying drawings.

DESCRIPTION OF THE PREFERRED EMBODIMENT

Figure 1:
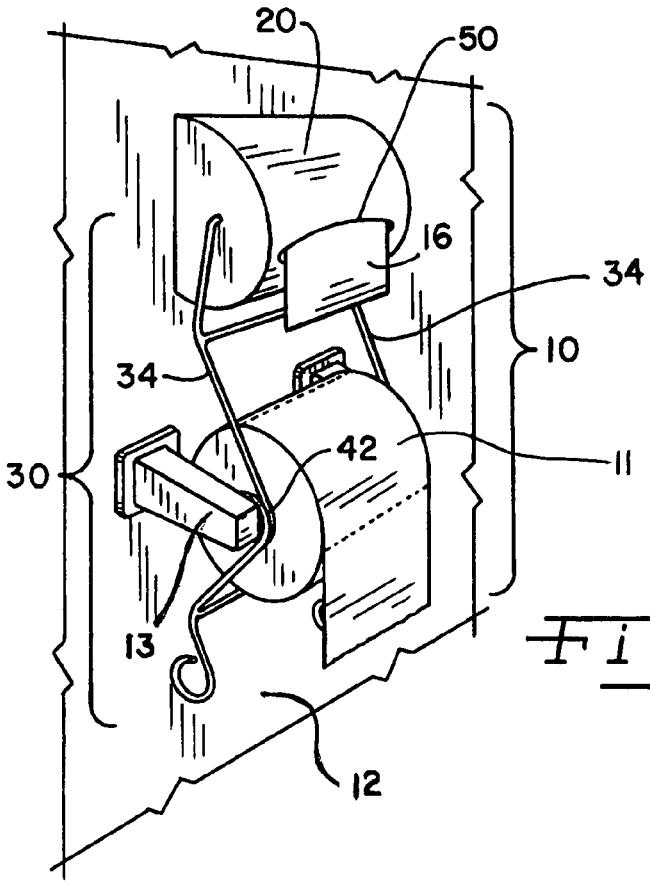
FIG. 1 is a side perspective view of one preferred embodiment of the present novel technology, shown mounted to a conventional toilet tissue holder or dispenser.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

A first embodiment of the present novel technology, as shown in FIGS. 1-4, presents a device 10 that conveniently dispenses towelettes. This invention may also be used with pre-moistened towelettes or "wet wipes." Dispenser 10 comprises a housing 20 and a frame 30 wherein the housing 20 is attached to the top of the frame 30 by conventional means. Frame 30 includes two parallel-spaced opposing support arms 34 and a mounting assembly 40 (see FIG. 3). Mounting assembly 40 comprises two ring-like portions 42 of arms 34 intended to be positioned on either side of a toilet tissue roll assembly such that the expandable rod or spindle equipped on a conventional toilet tissue dispenser passes both through the portions 42 and the toilet tissue roll wherein the ring-like portions 42 are disposed on opposing sides of the tissue roll 11. Alternatively, the mounting assembly can take the form of solid mounts 140 and 340 shown and discussed below in relation to FIGS. 12 and 14, respectively, affixed to frame 30, or the form of the mounting means 540 and 640 shown and discussed below in relation to FIGS. 16 and 18, respectively.

A conventional toilet tissue dispenser, which is typically permanently mounted on a vertical surface, wall or partition 12, includes opposing posts or brackets 13 that typically project outwardly from the surface 12 and that include receiving sockets (not shown) disposed adjacent their distal ends. The support arms 34 of frame 30 extend beyond the mounting assembly 40 such that portion 41 bears against the surface 12, thereby maintaining the frame 30 in a substantially vertical position. The support arms 34 are preferably flexible, allowing the dispenser 10 to be mounted on both flat and irregular wall or partition surfaces.

In the embodiment shown in FIGS. 1-4, housing 20 is in the shape of a half-cylinder disposed in a horizontal position with an opening 50 located in the outward-facing wall thereof, through which one can dispense a towelette 16. Towelettes contained in the housing 20 may be replenished through an opening 60 provided in the inward-facing opposite side of the housing (see FIG. 4).

Figure 2:
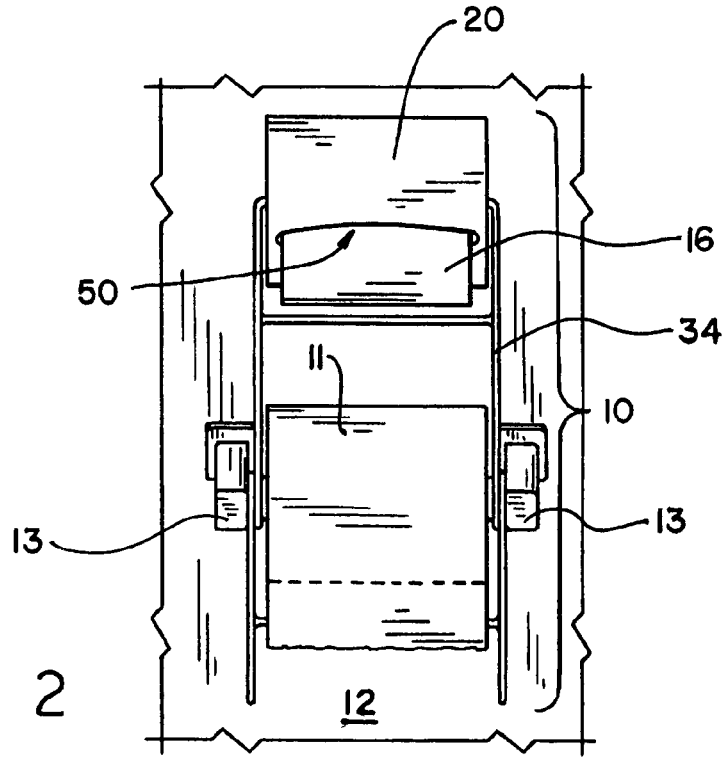
FIG. 2 is a front perspective view of the embodiment shown in FIG. 1.
Figure 3:
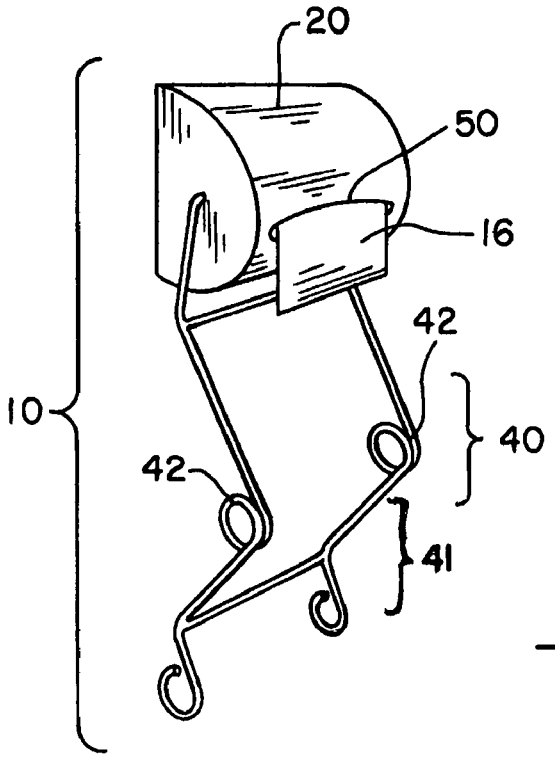
FIG. 3 is a side perspective view of the embodiment of FIG. 1 shown in isolation.
Figure 4:
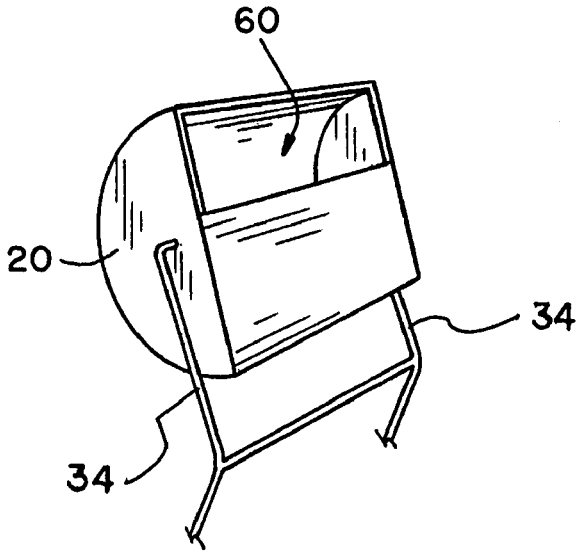
FIG. 4 is a partial rear perspective view of the embodiment shown in FIG. 3.

As shown in FIGS. 1 and 2, the dispenser 10 is intended to be detachably coupled to a conventional toilet tissue holder or dispenser in a manner that does not interfere with the dispensing of toilet tissue. To assembly dispenser 10 onto a conventional tissue dispenser, the tissue roll spindle (not shown in FIGS. 1-4) is positioned concentrically within the tissue roll cylinder and also between the opposing portions 42 of the dispenser frame 30. The entire combination (the spindle, the tissue roll and the dispenser 10) is then positioned between the opposing brackets 13 that project outwardly from surface 12 and the opposing ends of the spindle, which are spring-biased in outwardly opposing directions, are compressed inwardly toward each other and arranged in alignment with the receiving sockets of each bracket 13. Once so positioned, the ends of the spindle are then released and naturally tend to bias outwardly in opposing directions to rest securely within the sockets under sufficient tension force to secure the dispenser 10 in position. By its coupling to the toilet tissue dispenser, the dispenser 10 is conveniently located near the tissue roll and may be removed when no longer needed.

Figure 5:
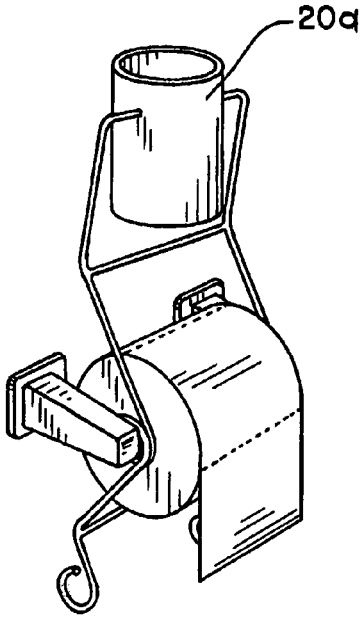
FIG. 5 is a side perspective view of another preferred of the present invention, shown mounted to a conventional toilet tissue holder or dispenser.

Dispenser 10 can be manufactured in several different shapes and sizes to serve a variety of needs. In a further preferred embodiment, as shown in FIG. 5, housing 20*a* may be formed in the shape of a commercially available wet wipes container (e.g. an upright cylinder or four sides perpendicular to a rectangular base) having an open top. Housing 20*a* may hold a container in place such that the container extends above the open top of the housing 20*a*. When the towelettes container is empty, it may be replaced by simply lifting the container up and out of the housing 20*a*.

Figure 6A:
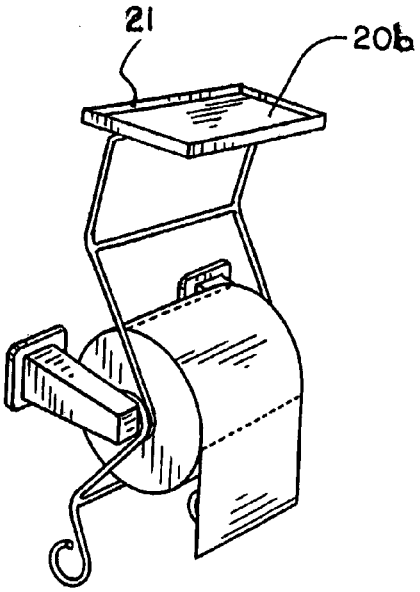
FIGS. 6A and 6B are side perspective views of further preferred embodiments of the invention, shown mounted to a conventional toilet tissue holder or dispenser.
Figure 6B:
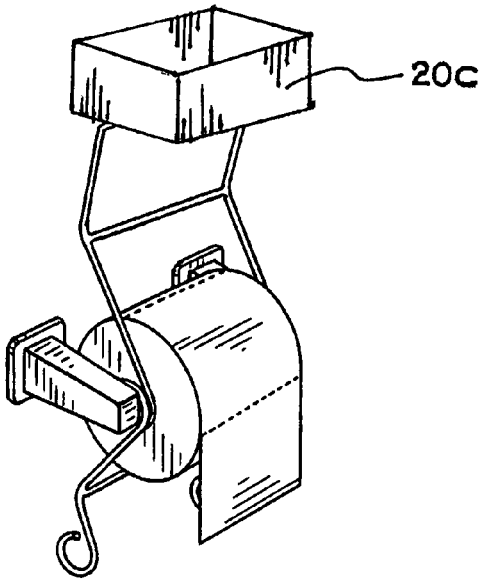

In yet further preferred embodiments, shown in FIGS. 6A and 6B, the housing may be defined by a flat shelf 20*b* for supporting a box-shaped commercially available wet wipes container. Such a housing 20*b* may be equipped with a lip or slight ledge 21 extending partially or completely about its top-side perimeter to prevent the box-shaped container from sliding off the shelf 20*b*. A further embodiment of a housing 20*c* is shown in FIG. 6B as having an open-top box shape.

Figure 7:
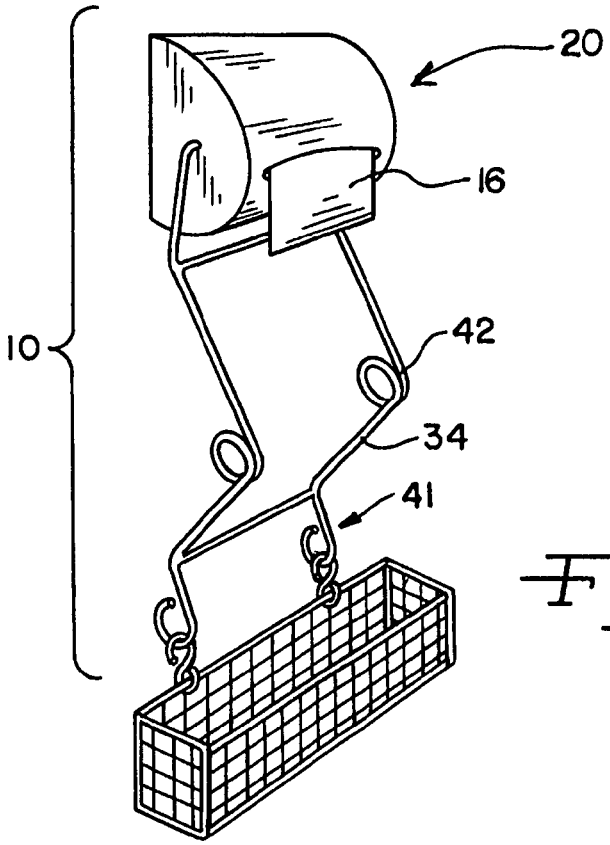
FIG. 7 is a front perspective view of the embodiment shown in FIG. 3, shown equipped with an optional hanging tray.
Figure 9:
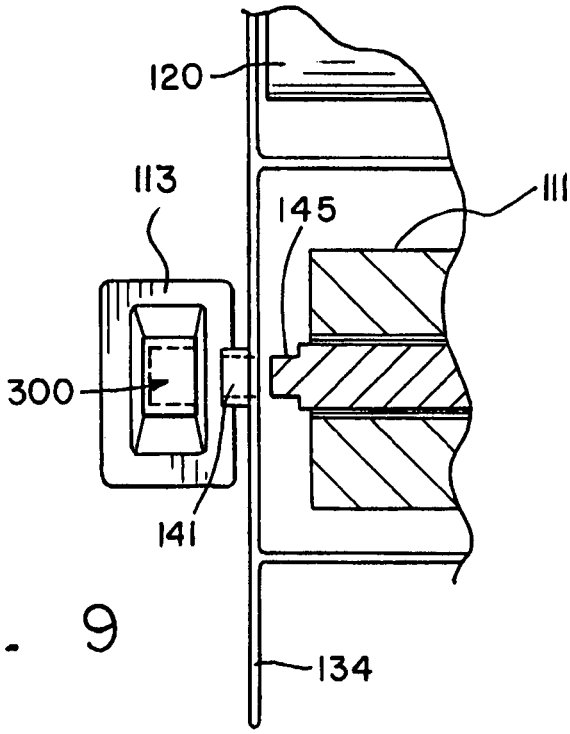
FIG. 9 is a side perspective view of the embodiment shown in FIG. 8.

As shown in FIG. 7, the lower portion 41 of each arm 34 may further include means for attaching light articles, such as a wire shelf or basket, small magazine rack, or the like, to the frame assembly.

Dispenser 10 and frame 30 may be constructed of different materials, such as metal or plastic. Frame 30 may further be constructed of round wire or of flat material. Preferably, frame 30 is constructed of a flexible, light-weight metal (most preferably aluminum).

Unlike the embodiments discussed above, in which the expandable spindle or rod of the tissue dispenser passes through the mounting portions 42 to thereby secure the dispenser 10 in position, it may also be desirable that the dispenser remain in place in the toilet tissue dispenser even when the spindle is removed and the tissue roll is removed or changed.

In yet another preferred embodiment, shown in FIGS. 8-13, a towelette dispenser 110 comprises a housing 120 and a frame 130 wherein housing 120 is attached to the top of the frame 130. In a preferred embodiment, frame 130 comprises two vertical support members 134, one or more cross supporting members 136 and at least two mount members 140. Mount members 140 include outwardly extending lugs or abutments 142 disposed on support members 134 that align with the bearing sockets 300 of a conventional tissue roll holder bracket 113 (see FIG. 9). The interior of the mounts 140 are situated to receive the respective ends of the tissue roll spindle 145. Thus, the dispenser 110 may remain in place as the toilet tissue roll is removed or changed.

Typically, the support members 134 extend beyond the mount members 140 such that portion 141 rests or bears against the vertical wall or partition, thereby maintaining the wire frame 130 in a substantially vertical position. The supporting cross members 136 assist in maintaining the verticality and rigidity of frame 130. Support members 134 are preferably flexible, allowing the wet wipe dispenser 110 to be mounted on both flat and irregular vertical wall or partition surfaces.

The desire for sanitation of one's hands prior to arising from the toilet often requires that wet wipes are available without one having to touch the dispensing container. Again, the claimed technology satisfies such a need. As shown in FIGS. 8-13, and more particularly in FIGS. 10-12, a further preferred embodiment of a novel toilet tissue spindle 145 comprises an outer member 150, an inner member 160 and a biasing member 170. Outer member 150 has an internal cavity 152 within which is slidably received the inner member 160 and biasing member 170. Member 170 may be defined by a spring under compression or any means that urges the outer and inner members in opposite directions such that the spindle must be compressed in length to be positioned in alignment with the tissue holder brackets. Internal cavity 152 has an open end 153 and an opposing closed end 154. Spring 170 is located at one end of the internal cavity 152 adjacent closed end 154. Inner member 160 is arranged within the cavity 152 adjacent the open end 153 and has opposing ends 160*a* and 160*b*. Inner member 160 is provided at its first end 160*a* with an abutment surface that engages the spring 170. (Alternatively, member 160 may itself be somewhat hollow or tube-like such that spring 170 extends interiorly of member 160 and engages an internal abutment surface disposed closer in proximity to end 160*b* than end 160*a* is currently shown in FIG. 10.) At the opposing end 160*b* the inner member 160 is provided with a male end 165 to align with the interior of the mount 140.

Outer member 150 is provided with a plurality of bristles 180 that extend radially outwardly and that are of sufficient stiffness and length to engage the interior of the central liner or cylinder of a toilet tissue roll about which the tissue is rolled. The end of the outer tube 150 opposing its open end is equipped with a disc 190 arranged perpendicular to the rotational axis "a" of spindle 145. Disc 190 is provided with a male end 195 to align with the other mount 140. Compression spring 170 biases the spindle 145 to remain within the mounts 140 to secure a toilet tissue roll therebetween. When toilet tissue paper is dispensed by the user, the bristles 180 are engaged by the interior of the cylinder liner of the tissue roll, thereby causing the spindle assembly 145 to likewise rotate.

Figure 12:
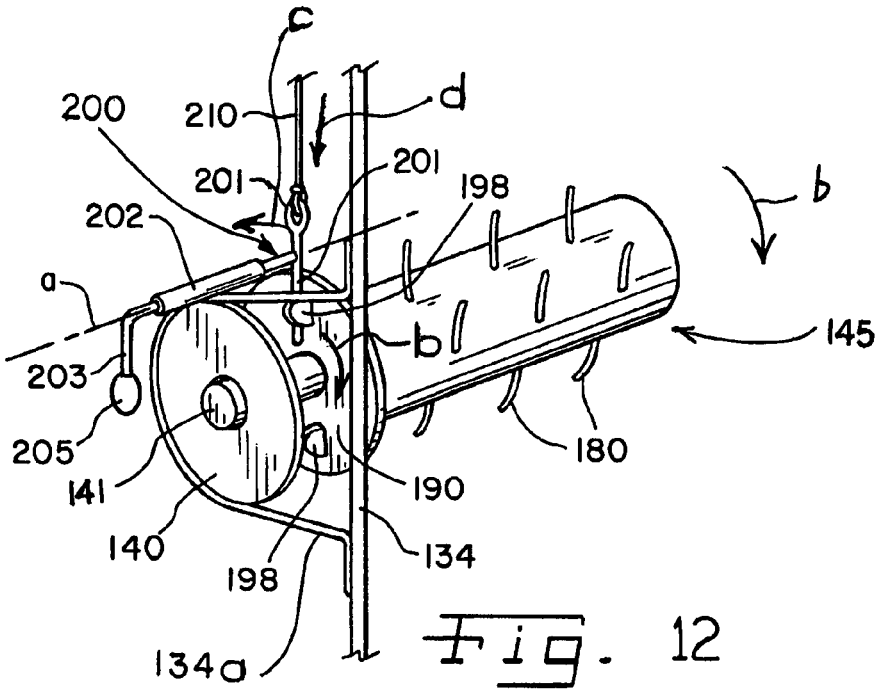
FIG. 12 is an enlarged perspective view of the spindle and activation arm assembly of the embodiment shown in FIG. 8.
Figure 13:
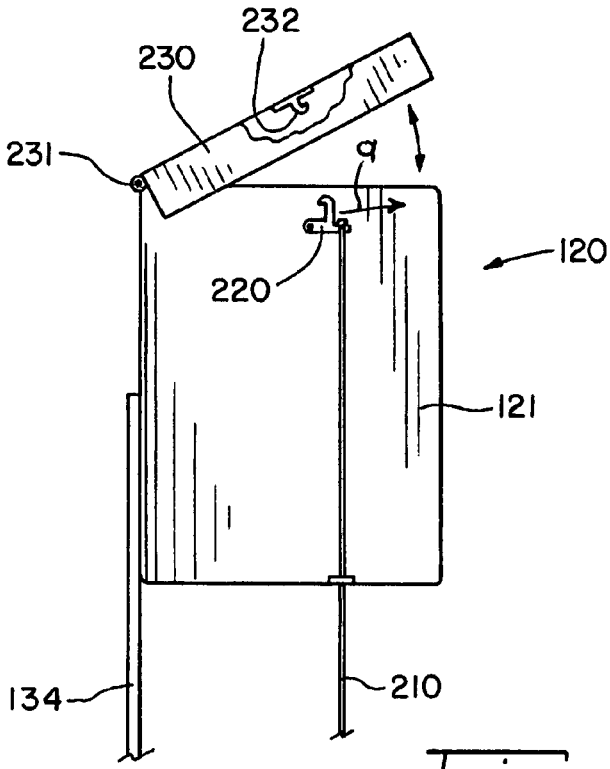
FIG. 13 is a side perspective view of the wipes holder and latch mechanism of the embodiment shown in FIG. 8.

Referring now to FIGS. 12 and 13, as spindle 145 is rotated, one or more protruding knobs 198 disposed on disc 190 likewise rotate and engage a vertical portion 201 of activation arm 200, which is secured in place by, and rotates freely about its axis "a" within, a sleeve or tube 202, which is fixed to extensions 134*a* of support arm 134. Arm 200 is connected at the upper end of its vertical portion 201 to a cable 210. In operation, upon the user pulling tissue paper from the roll, thereby causing the toilet roll to rotate in the direction of reference arrow "b" in FIG. 12, spindle 145 will, due to the engagement of the tissue roll liner with the bristles 180, correspondingly rotate in the direction of reference arrow "b" as well. The rotation of spindle 145 causes protruding knob 198 to likewise rotate and impact the vertical portion 201 of activation arm 200, thereby swinging arm 200 about its axis "a" in the direction of reference arrow "c," which in turn acts to pull cable 210 in a downward direction (see reference arrow "d").

As shown in FIG. 13, the opposite (upper) end of the cable 210 is connected to a latch mechanism 220 located within the housing 120. In this embodiment housing 120 has a lower box-like portion 121 and a cover or lid 230 held closed by latch mechanism 220 affixed to lower portion 121 and a mating latch member 232 affixed to lid 230. Lid 230 is connected along one side to housing 120 via a spring hinge 231 that acts to bias the cover 230 in an upward or open direction. Alternatively, hinge 231 may be a simple hinge while the housing 120 may include another form of biasing means that acts to push or urge the cover upwardly when the latch is not engaged.

In operation, when the activation arm 200 is engaged and rotates, the cable 210 is pulled downwardly and the latch mechanism 220 is activated in the direction of reference arrow "a", thereby releasing the lid 230 of housing 120 in the open and upward direction. This allows the towelettes stored inside the housing 120 to be accessed by the user without touching the dispensing container. Once the lid has been opened it will remain in an open position because of the housing's internal biasing means (i.e. spring hinge 231 in FIG. 13).

Arm 200 has a second vertical portion 203 disposed opposite vertical portion 201 and provided with a weighted distal end 205, which causes the arm 200 to return freely to a substantially vertical position following activation. After using the towelette, a user may simply close the lid 230, which is then held closed by the latch mechanism 220 until its next use, thereby protecting the towelettes from prolonged exposure to the ambient atmosphere, particularly if they are pre-moistened.

Figure 8:
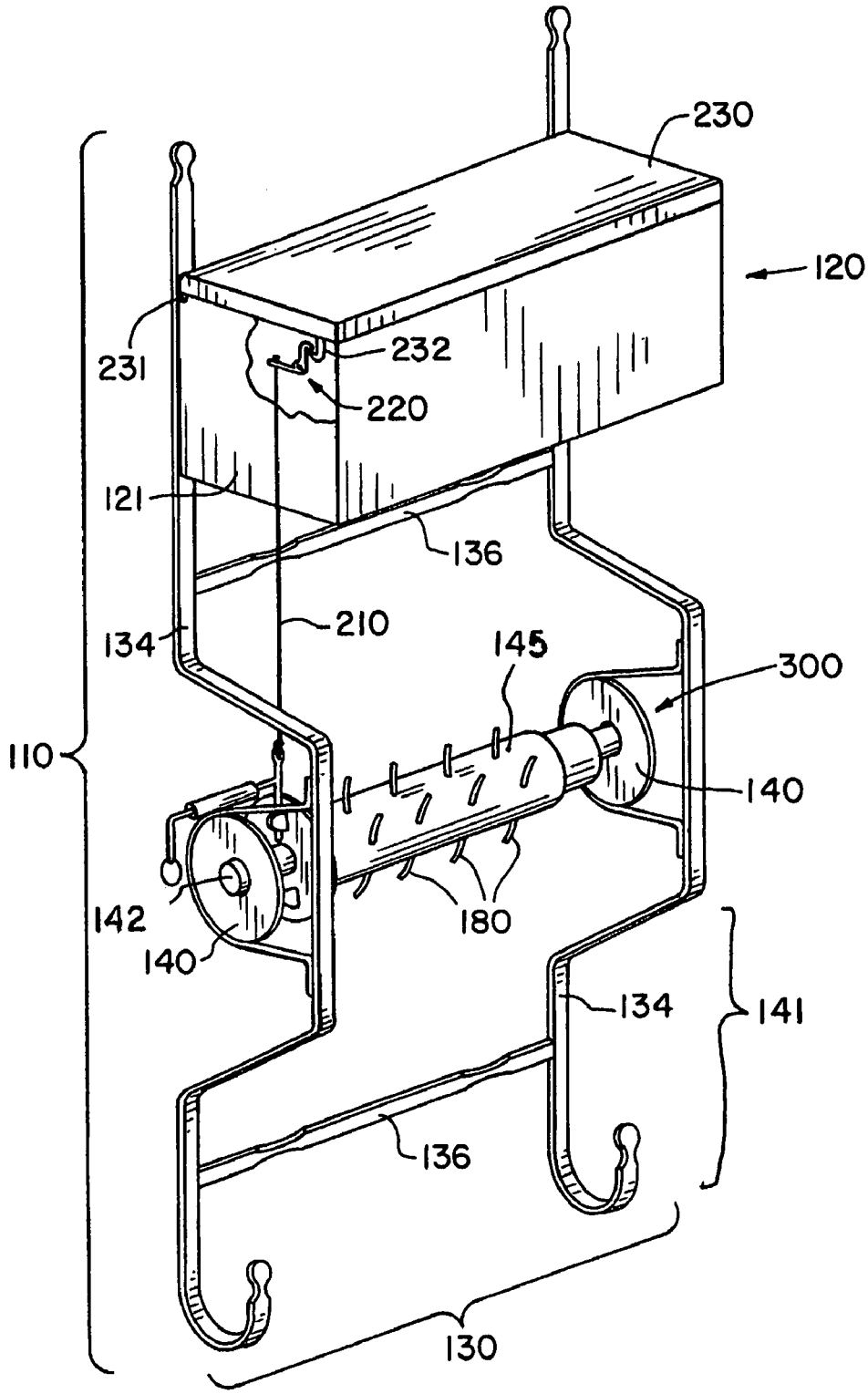
FIG. 8 is a front perspective view of a yet another preferred embodiment of the present invention.
Figure 10:
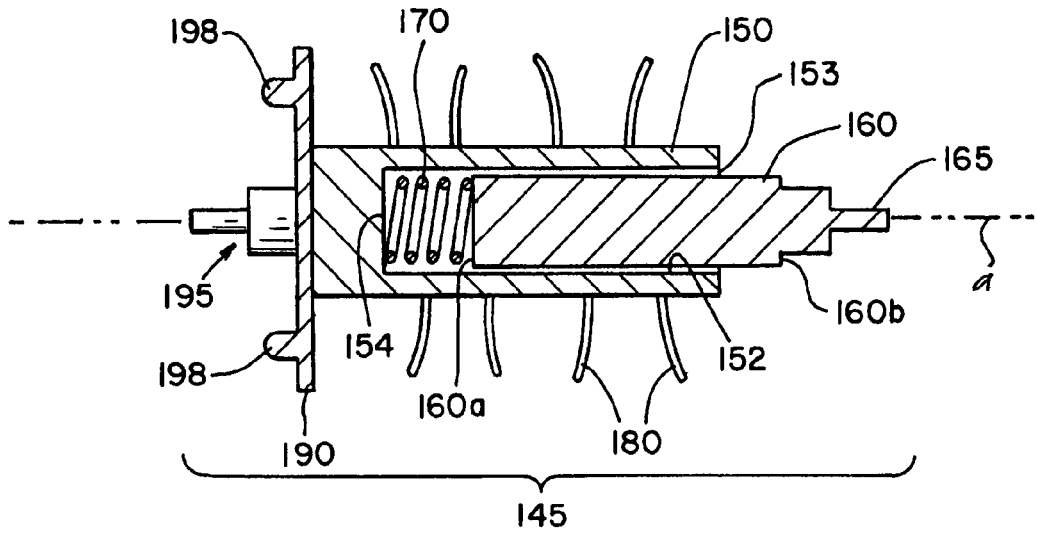
FIG. 10 is an enlarged perspective view of the spindle assembly of the embodiment shown in FIG. 8.
Figure 11:
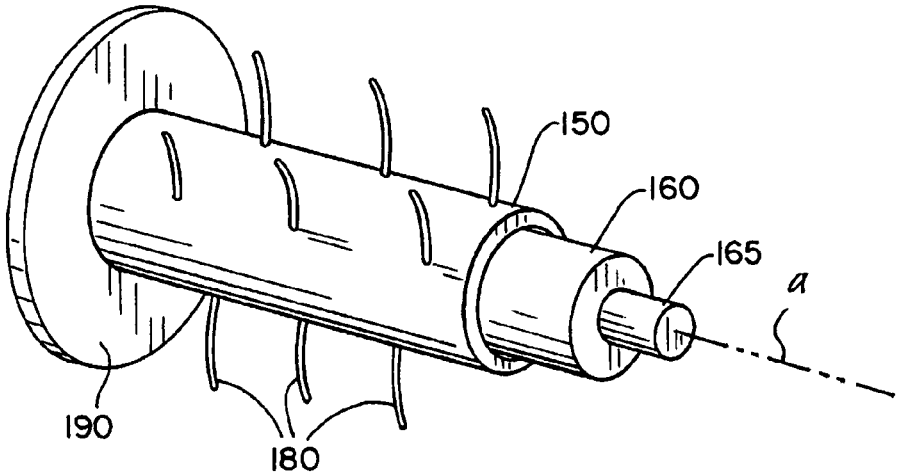
FIG. 11 is another enlarged perspective view of the spindle assembly of the embodiment shown in FIG. 8.

As shown in FIG. 8, light items, such as a wire shelf, light waste basket, small magazine rack, or the like, may be hung from end portions 141 of the support arms 134 in a manner similar to that shown in FIG. 7.

Dispenser 110 may be constructed of different materials such as metal or plastic. Frame 130 may be constructed of round wire or of flat materials. The preferred material is lightweight aluminum.

Figure 14:
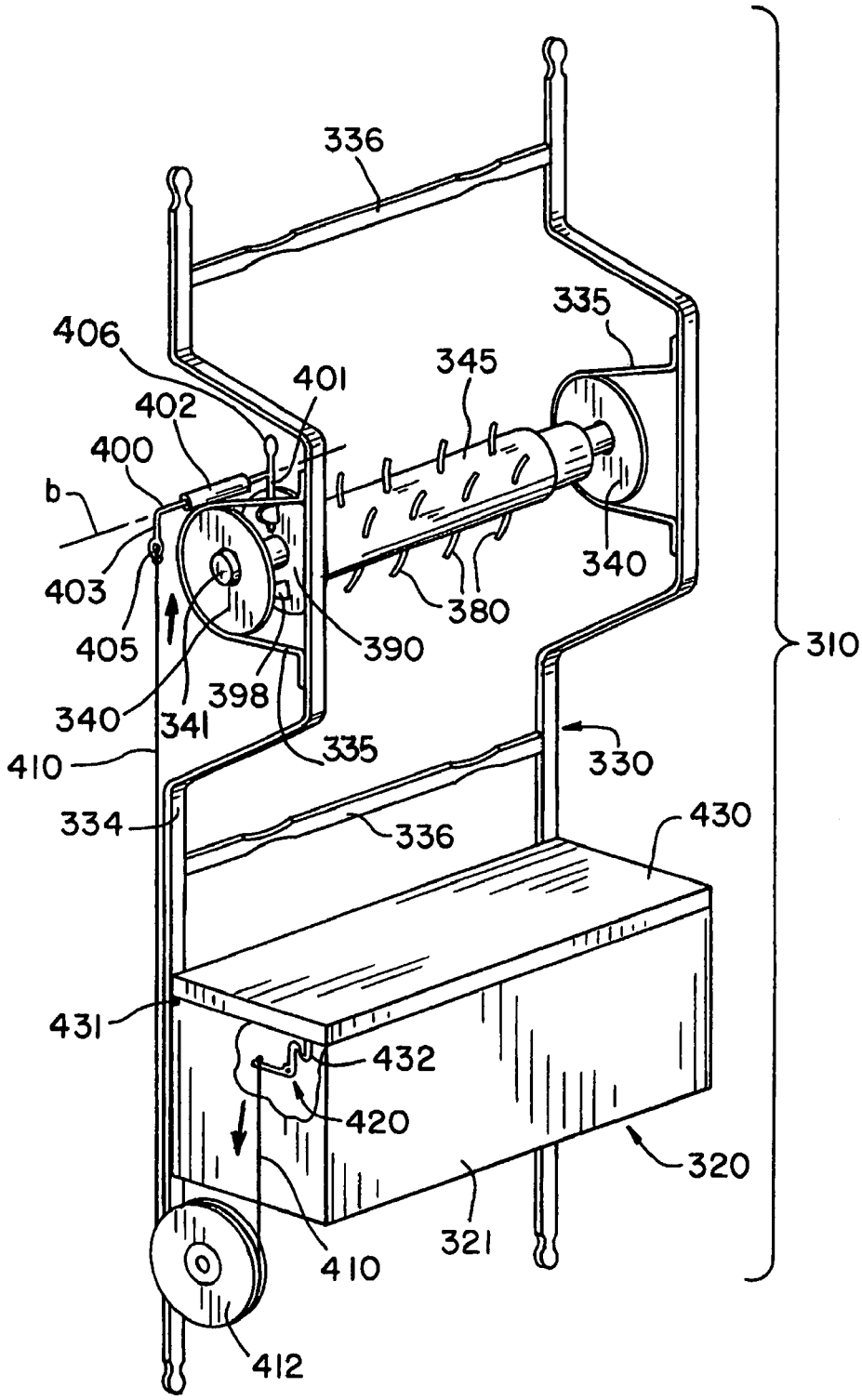
FIG. 14 is a front perspective view of a further preferred embodiment of the present invention.

In yet another preferred embodiment, shown in FIG. 14, a dispenser 310 is designed to allow placement of the dispenser 310 below the toilet tissue holder. Dispenser 310 comprises a housing 320 and a frame 330 wherein the housing 320 is attached to the bottom of the frame 330. Frame 330 comprises two vertical support members 334, one or more supporting cross members 336 and two mounts 340. Mounts 340 include outwardly extending abutments 341 that align with the bearing sockets of a conventional tissue roll holder bracket. The interior of the mounts 340 are situated to receive the respective ends of a spindle 345. The spindle 345 is identical to the spindle 145 shown and discussed in relation to FIGS. 10-13 above.

In this embodiment, the vertical support arms 334 extend beyond the mounts 340 and rest or bear against the vertical wall or partition, thereby maintaining frame 330 in a substantially vertical position. The supporting cross members 336 assist in maintaining the verticality and rigidity of the frame 330. Support arms 334 are preferably flexible, allowing the wet wipe dispenser 310 to be mounted on both flat and irregular vertical wall or partition surfaces.

Dispenser 310 operates in a manner substantially identical to that shown and discussed in relation to FIGS. 12 and 13. When tissue paper is dispensed, bristles 380 on the spindle 345 are engaged by the interior of the cylinder liner of the tissue paper roll and cause the spindle 345 to likewise rotate. One or more protruding knobs 398 provided on disc 390 disposed on the end of the spindle 345 also rotate and engage vertical portion 401 of activation arm 400, which is secured and allowed to rotate freely within tube 402 affixed to extensions 335 of support arms 334, thereby causing the arm 400 to rotate about its axis "b".

Activation arm 400, like its counterpart activation arm 200 shown in FIG. 12, includes opposing vertical portions 401 and 403. However, because of the orientation of housing 320 below the spindle assembly, outer vertical portion 403 is attached at its distal end to a cable 410, while inner vertical portion 401 is provided with a weighted portion 406 at its upper distal end. The opposite end of the cable 410 is connected to a latch mechanism 420 located within the housing 320 after passing around a static or non-rotating wheel 412. Housing 320 has a lower box-like portion 321, a cover or lid 430 held closed by latch mechanism 420 affixed to lower portion 321, and a latch member 432 affixed to the lid 430. Lid 430 is connected along one side to housing 320 via a spring hinge 431 in a manner similar to hinge 231 shown in FIG. 13.

In use, when arm 400 is engaged and rotates, the cable 410 is pulled upwardly and, in cooperation with static wheel 412, the latch mechanism 420 is activated, thereby releasing the lid 430 of housing 320 in an upward or open position. This allows the towelettes stored inside the housing 320 to be accessed without requiring the user to touch the dispensing container. Weighted end 405 causes the arm 400 to return freely to a substantially vertical position following engagement. After use, a user may simply close the lid 430, which is then held closed by the latch mechanism 420 until its next use, thereby preventing the towelettes from prematurely drying.

Figure 15:
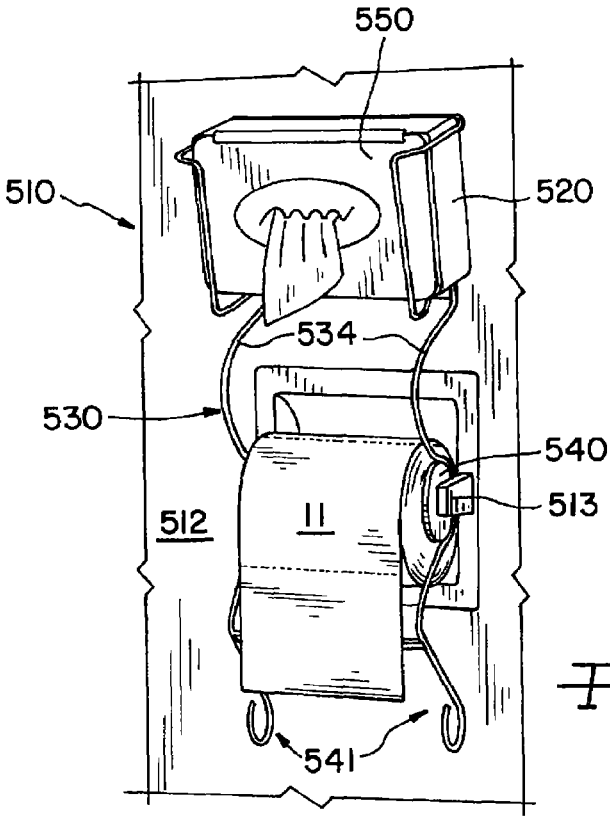
FIG. 15 is a perspective view of yet another preferred embodiment of this invention shown mounted to a conventional toilet tissue holder or dispenser and housing a conventional container of pre-moistened towelettes.
Figure 16:
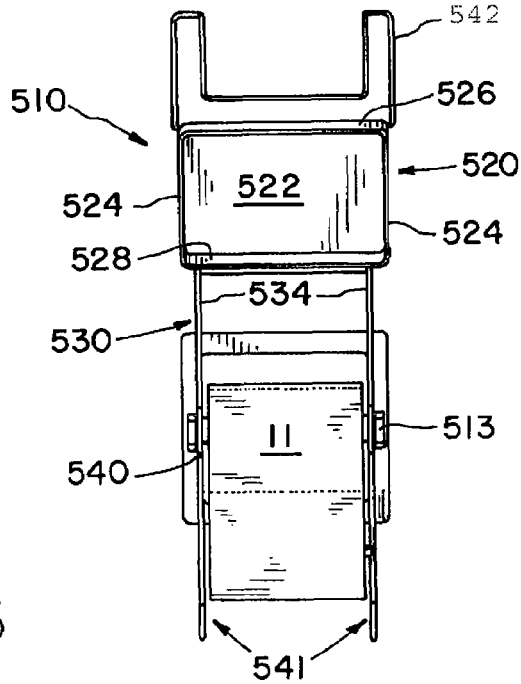
FIG. 16 is a front view of the embodiment shown in FIG. 15 without a towelette container housed therein.
Figure 17:
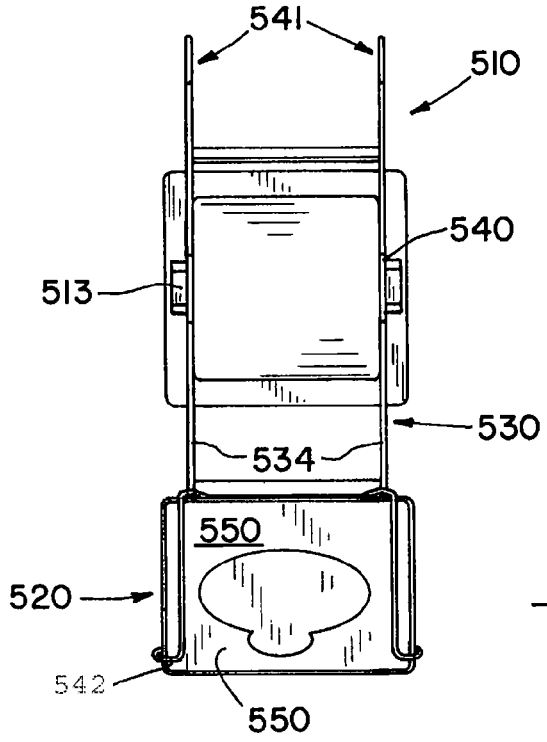
FIG. 17 is a front view of a further embodiment of this invention shown mounted to a conventional toilet tissue holder or dispenser and housing a conventional container of pre-moistened towelettes.

Another embodiment of the present invention, shown in FIGS. 15-17, presents a dispenser 510 comprising a housing 520 and a frame 530 wherein the housing is attached adjacent to one end of frame 530. In FIG. 15 the dispenser is shown housing a conventional container 550 of pre-moistened towelettes. Frame 530 includes two vertical support arms 534 and a mounting assembly 540, which is to be positioned on either side of the toilet tissue roll 11 such that the spindle equipped on a conventional toilet tissue holder bears outwardly in opposite directions against assembly 540 to secure the frame in place within the tissue holder brackets 513. Support arms 534 extend beyond the mounting 540 in a direction opposite that of housing 520 such that portions 541 bear against the vertical surface 512 to maintaining the frame in a substantially vertical position. Here again, support arms 534 are preferably flexible so the dispenser 510 can be mounted on both flat and irregular wall or partition surfaces. As with all previous embodiments, dispenser 510 is intended to be coupled to a conventional toilet tissue dispenser in a manner that does not interfere with the dispensing of toilet tissue.

As shown best in FIG. 16, housing 520 includes an open-faced cabinet member comprising a vertical back wall 522, opposing vertical side walls 524, a horizontal top wall 526 and an opposing bottom wall 528. Pivotally attached to housing 520 is a restraint bar 542 such that, once the conventional towelettes container 550 is placed within the housing 520, bar 542 can be swung over the open face of the housing to secure the container therein (shown best in FIG. 15). Bar 542 can be locked into the closed position by a variety of conventional means. FIG. 16 shows bar 542 in the up or open position. While bar 542 is shown pivotally attached to top wall 526 in FIGS. 15 and 16, bar 542 may be hingedly affixed to any of the walls forming the housing 520.

In FIG. 17, the dispenser frame assembly has simply been reversed and positioned in a 180-degree orientation than that shown in FIGS. 15 and 16, whereby the housing 520 is now positioned below the mounting means 540.

As can be appreciated from comparing the conventional tissue holder shown in FIG. 1, where there is no recess in the vertical surface to accommodate the tissue roll and the brackets 13 must extend a greater distance from the vertical surface to accommodate the roll, to the tissue holder shown in FIGS. 15-17, where the vertical surface does include a recessed area to accommodate the tissue roll such that the brackets do not have to extend outwardly from the vertical surface as far as they must in the FIG. 1 embodiment. An advantage of the present invention is that its flexible frame assembly allows it to accommodate either type of conventional tissue holder.

Figure 18:
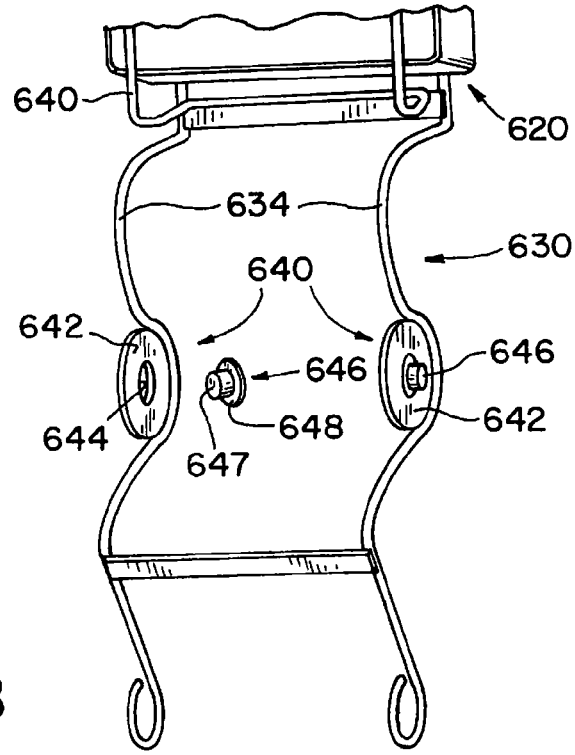
FIG. 18 is an enlarged view showing yet another preferred embodiment of the mounting means provided by this invention for releasably attaching the dispenser assembly of this invention to a conventional toilet tissue holder or dispenser.

FIG. 18 shows yet another embodiment of a means for mounting the dispenser frame assembly provided by the invention shown and discussed in relation to FIGS. 1-4 and 15-17. Mounting means 640 includes means 642 that are affixed to each vertical support arm 634 of the frame assembly 630. Means 642, which can take many forms but the preferred form is a generally circular plate, each has a central opening 644 therein in which a mounting cap 646 can be positioned. Cap 646 includes a protruding portion 647 and an annular ring portion 648, the diameter of which is greater than the diameter of central opening 644 to prevent the mounting cap from falling through the opening when positioned therein. When the tissue roll spindle is positioned between and bears outwardly against the opposing mounting caps, the spindle ends are received within portion 647, which in turn are received and rest within the bearing sockets of the tissue roll dispenser brackets. Alternatively, the mounting caps can be removed from plates 642 entirely so that the opposing ends of the tissue roll spindle extend through opening 644 and are received and rest within the bracket bearing sockets. Once positioned within the sockets, the ends of the spindle are biased outwardly in opposing directions to rest securely within the sockets under sufficient tension force to secure the dispenser in position.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make an infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

What is claimed is:

1. A towelette dispensing assembly releasably attachable about a spindle of a holder for a tissue paper roll, said holder being mounted upon a generally vertical surface, said tissue paper roll having a cylindrical central liner about which the tissue is wrapped, said tissue roll holder comprising a pair of opposing brackets projecting outwardly from the vertical surface, each said bracket including a socket area arranged adjacent its distal end, said dispensing assembly comprising:

a frame having a towelette dispensing portion and a mounting portion, said dispensing portion comprising a box-like cabinet for housing the towelettes to be accessed by the user, said cabinet including a cover that moves between a first biased open position and a second latched closed position, a tissue roll spindle passing through the mounting portion of said frame for securing said dispensing assembly upon the tissue paper roll holder, said spindle comprising:

an outer cylindrical member having an internal cavity with an open first end and an opposing closed second end;

an inner cylindrical member arranged to slidably reciprocate to and fro within the internal cavity of said outer member, said inner member having first and second opposing ends; and a biasing member located within the internal cavity of said outer member abutting its closed end;

wherein the inner member of said spindle further comprises at its first end an abutment surface that engages said biasing member and at its opposing second end a male end to align with and be received in one in one of the opposing socket areas of the brackets of said tissue holder in a freely rotating fashion, wherein the outer member of said spindle is provided with a plurality of radially extending bristles that are of sufficient stiffness and length such that, upon the tissue roll being rotated by a user, said bristles are engaged by the interior of the tissue roll liner and is thereby rotatingly driven; and means for releasing the lid of said dispensing portion, said releasing means being activated by the rotation of said tissue roll spindle.

2. The towelette dispensing assembly of claim 1 wherein the mounting portion of said frame comprises openings through which the tissue roll spindle may extend, thereby releasably securing said frame within the tissue roll holder.

3. The towelette dispensing assembly of claim 2 wherein said mounting portion further comprises removable means to be arranged within said openings such that when removed, the tissue roll spindle may extend therethrough releasably securing said frame within the tissue roll holder, and such that when in position within said openings, the opposing ends of the tissue roll spindle bear against said means which in turn is received within the tissue roll holder to releasably secure said frame within the tissue roll holder.

4. The towelette dispensing assembly as in claim 1 wherein said frame further comprises a second portion disposed opposite the dispensing portion, wherein said second portion bears against the vertical surface for supporting the frame in a generally vertical orientation.

5. The towelette dispensing assembly The dispenser of claim 4 wherein said second portion comprises means for attaching an article to said frame.

6. The towelette dispensing assembly of claim 5 wherein said article is defined by a shelf, a waste basket or a magazine rack.

7. The towelette dispensing assembly of claim 1 wherein said frame is constructed of flexible metallic or plastic material.

8. The towelette dispensing assembly of claim 1 wherein said towelettes are pre-moistened.

9. The towelette dispensing assembly as in claim 1 wherein the closed second end of said outer member of the tissue roll spindle is provided with a centrally located protruding male member male to align with and be received within, in a freely rotating manner, the socket area of the opposing bracket members of said tissue holder, said biasing member urging the opposing ends of said outer and inner members in opposite directions to secure under tension the spindle and the tissue roll within said holder.

10. The towelette dispensing assembly of claim 1 wherein said releasing means comprises:

a disc fixed adjacent the second closed end of said spindle in a plane normal to the axis of rotation of said spindle, said disc having at least one knob protruding therefrom; and an activation member that is connected to a latch mechanism housed at the dispensing portion, wherein the rotation of said spindle causes the likewise rotation of the disc and the likewise rotation of the at least one protruding knob carried thereon, said at least one protruding knob engaging the activation member upon its rotation whereupon the latch mechanism is activated to release the lid in the open position and allow the user access to the towelettes housed therein without having to come in contact with the dispensing assembly.

* * * * *

UNITED STATES PATENT AND TRADEMARK OFFICE

CERTIFICATE OF CORRECTION

PATENT NO. : 7,694,848 B2
APPLICATION NO. : 11/986207
DATED : April 13, 2010
INVENTOR(S) : Thomas S. Petry It is certified that error appears in the above-identified patent and that said Letters Patent is hereby corrected as shown below:

In column 9, line 6, please delete the second occurrence of the words "in one.".

In column 10, line 1, please delete the words "The dispenser.".

In column 10, line 15, please delete the word "male" and insert in lieu thereof --made--.

Signed and Sealed this

Eighth Day of June, 2010

David J. Kappos

David J. Kappos
*Director of the United States Patent and Trademark Office*